US006079521A

United States Patent [19]

Schönauer et al.

[11] Patent Number: 6,079,521

[45] Date of Patent: Jun. 27, 2000

[54] MEASURING ELEVATOR POSITION WITH SCANNING LASER BEAM

[75] Inventors: Uwe Schönauer; Peter L. Herkel, both of Berlin, Germany

[73] Assignee: Otis Elevator Company, Farmington, Conn.

[21] Appl. No.: 09/198,980

[22] Filed: Nov. 24, 1998

[51] Int. Cl.[7] ..... B66B 1/34

[52] U.S. Cl. ..... 187/393

[58] Field of Search ..... 127/393, 394, 127/399

[56] References Cited

U.S. PATENT DOCUMENTS

| | | | |
|---|---|---|---|
| 5,151,562 | 9/1992 | Fujita et al. | 187/134 |
| 5,306,882 | 4/1994 | Gerwing et al. | 187/134 |
| 5,393,941 | 2/1995 | Mizuno et al. | 187/293 |
| 5,509,505 | 4/1996 | Steger et al. | 187/394 |
| 5,869,794 | 2/1999 | Speiss | 187/287 |

FOREIGN PATENT DOCUMENTS

| | | |
|---|---|---|
| 532149 | 9/1997 | European Pat. Off. . |
| 537638 | 11/1997 | European Pat. Off. . |
| 19617519 | 2/1996 | Germany . |
| 6-156987 | 6/1994 | Japan . |

*Primary Examiner*—Jonathan Salata

[57] ABSTRACT

A laser disposed on an elevator car is scanned at a uniform rate; one or more pairs of sensors disposed on opposite sides of the hoistway determine the time for the laser to scan from one sensor to the other, from which the vertical distance between the elevator car and a sensor pair is determined, thereby to derive hoistway position, elevator speed and acceleration.

6 Claims, 2 Drawing Sheets

MEASURING ELEVATOR POSITION WITH SCANNING LASER BEAM

TECHNICAL FIELD

This invention relates to using a scanning laser and sensors to determine the position and speed of an elevator car in the hoistway.

BACKGROUND ART

In order to control the motion of an elevator car in the hoistway, precise and reliable measurements of its position and speed are essential. Conventionally, an incremental encoder or a series of switches in the hoistway are used to determine position and speed of an elevator car.

One new option is the use of a laser for measuring distance based on triangulation, measurement of diffraction, measurement of interference, or measurement of transit time. Applied at distances ranging from 1 to 100 meters or more, these methods have disadvantages which make their use for an elevator difficult and expensive. The requirement of a long coherent laser beam, the difficulty in measuring extremely short transit times related to the travel of the light, and the ambiguity of resulting patterns are inherent in those methods. In addition, the installation of a transmitter, receiver or reflector on the car creates the serious technical difficulty of aiming and reflecting a thin laser beam from a laterally moving and swaying surface over distances up to 100 meters.

DISCLOSURE OF INVENTION

Objects of the invention include improved determination of the position and speed of an elevator car.

According to the present invention, an elevator car's position and speed is determined by using an angular sweep of a laser beam. The time intervals to be measured are set to be in an order of magnitude which can conveniently be handled by digital timers, electronic circuits and microprocessors.

The laser beam moves like a long, inertialess pendulum oscillating with a known frequency within the limits of a fixed oscillating angle. The time function of the angle is known (for instance linear) and stored in the microprocessor system. In this setup, the time interval T that the laser beam needs to cover a fixed horizontal distance H in the center of its scan is used to measure the vertical distance V between the sensor pair and the car. Other objects, features and advantages of the present invention will become more apparent in the light of the following detailed description of exemplary embodiments thereof, as illustrated in the accompanying drawing.

BEST MODE FOR CARRYING OUT THE INVENTION

Figure 1:
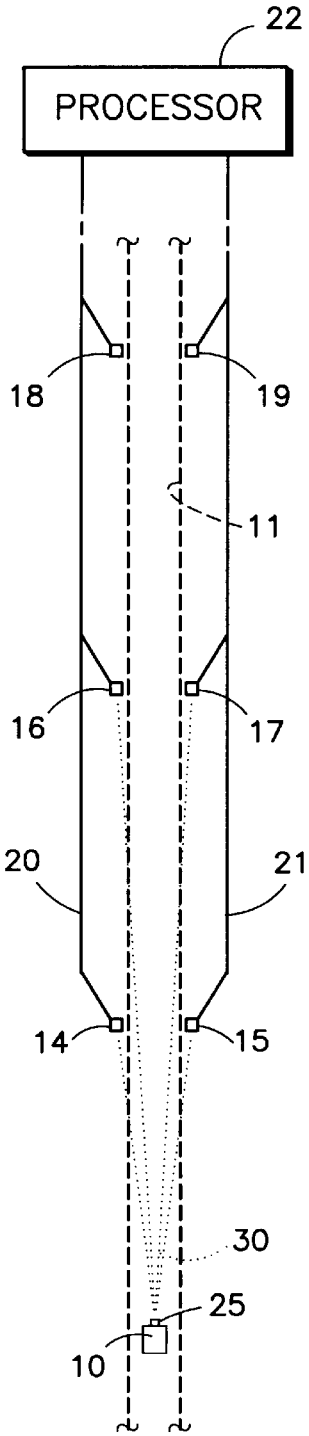
FIG. 1 is a simplified schematic diagram of an elevator system employing the invention.
Figure 2:
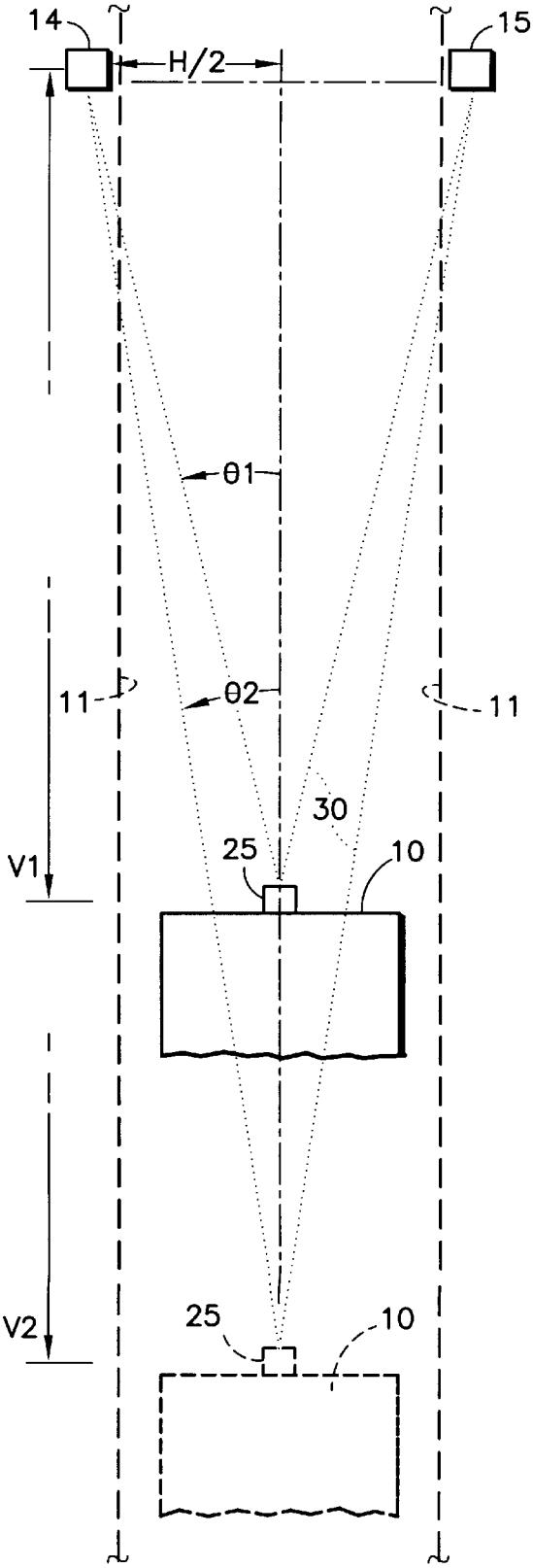
FIG. 2 is a partial, simplified schematic diagram illustrating the parameters of the system in FIG. 1.

Referring to FIGS. 1 and 2, an elevator 10 is moveable vertically within a hoistway 11. On opposite sides of the hoistway are a plurality of pairs of optical detectors or sensors 14–19 which are connected by suitable circuits 20, 21 to a microprocessor 22. A laser 25 on the elevator 10 provides a beam 30 that scans across the hoistway, and is detected by the sensors 14–19. Since each sensor pair is read separately, the identity of the sensor pair which provided the signals is known.

Definitions:

H=horizontal spacing of sensor pair

V=vertical distance of car relative to sensor pair

T=time between adjacent responses of sensor pair w=angular rate of scanning laser θ=one-half of the angle subtended by scan between sensors $$\mathrm{Tan}\theta = \frac{\frac{1}{2}H}{V}$$

$$\theta = w\left(\frac{1}{2}T\right) \qquad \text{(for linear scan)}$$

$$V = \frac{H}{2\mathrm{Tan}\left(\frac{1}{2}wT\right)}$$

Since the position of the sensor is known, the position of the car is determined by its deviation, V, from the position of the sensor. Determining the car position to be either above or below a sensor pair is determined by the up/down direction of elevator motion. As is evident from FIG. 1, measurements from more than one pair at a time may be made, depending upon the installation. In a small building (only several floors) only a single sensor pair is necessary.

From the position determined by V, relative to the position of sensor pairs, velocity can be determined by the change in position from one sensing/processing cycle to the next, and acceleration can be determined conventionally from that.

Figure 3:
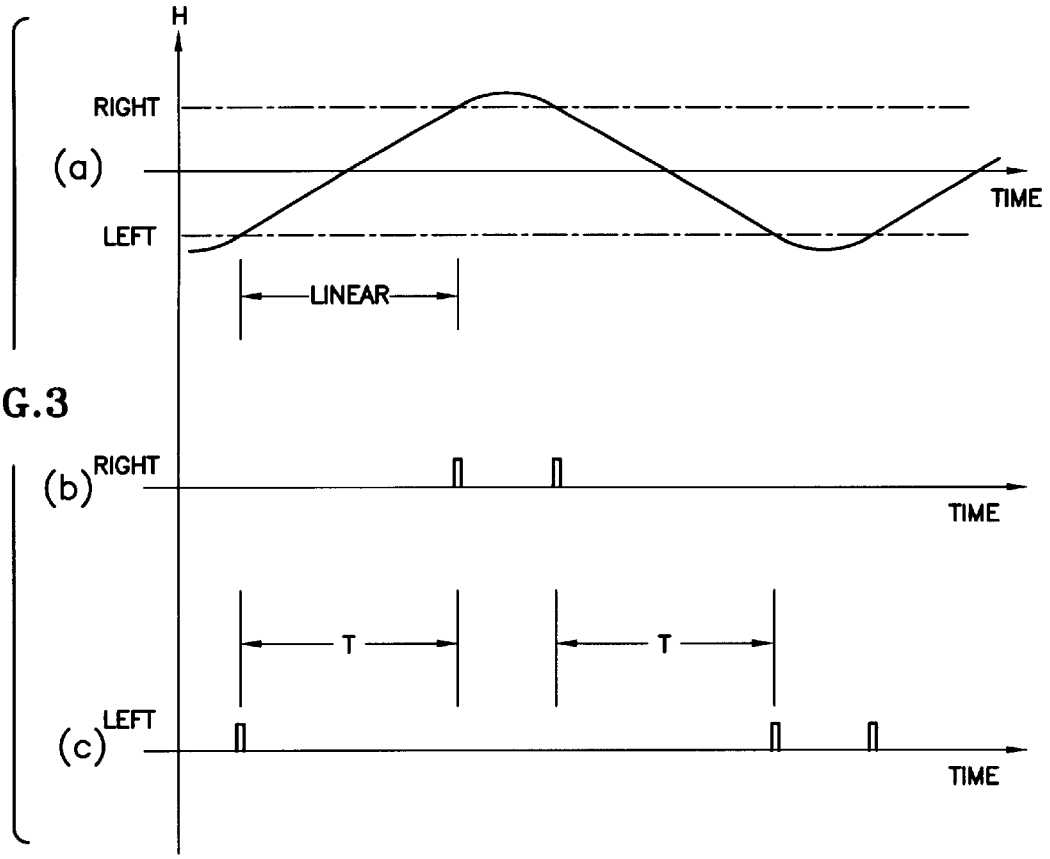
FIG. 3 is a series of illustrations of operating parameters on a common time scale.
Figure 4:
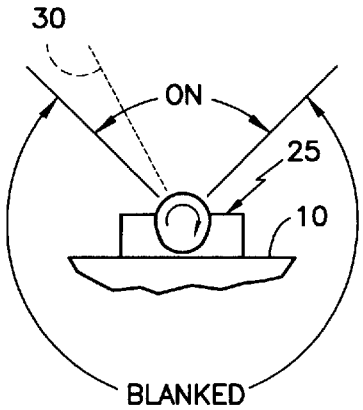
FIG. 4 is a partial schematic illustration of a full circle scan of a laser.

Referring to FIG. 3, illustration (a) shows an example of a scan or sweep which might provide a linear angular rate between the sensors, and turnaround to provide a linear angular rate return scan. In such a case, each sensor would be activated twice between each activation of the other sensor, as shown in illustrations (b) and (c) of FIG. 3. The time, T, essential to the measurement, is that which occurs between the leading edges of adjacent pulses of opposite sensors, as shown in illustrations (b) and (c). The scan, however, need not be as shown in FIG. 3. For instance, the scan need not be linear between the sensors; it might be sinusoidal, but that complicates the processing. On the other hand, a scan that would be easiest to facilitate and with the least wear on the equipment would be a continuous scan, in which the laser itself would be blanked (turned off) except during a period of time when the beam might possibly intersect the sensor, as is illustrated in FIG. 4. Other scans may be used to suit any implementation of the present invention. The sweep need not oscillate, nor even be cyclically repetitive at regular intervals.

The embodiment of FIGS. 1 and 2 provides a laser scan only above the car; however, it could be below the car, or in both directions, if desired in any given implementation of the invention.

If the microprocessor system monitors not only the time T between the two sensors but also the "turnaround times" outside of the sensor-distance, it can detect any deviation of the sensor position from the center of the beam's oscillation. Moreover, it can detect changes in the oscillatory frequency as well. Both of these effects can then easily be filtered out of the measurements, provided that the type of time function of the angular motion has not changed (like from linear to sinusoidal). Thus, the measurements are accurate notwithstanding lateral and swaying motion of the car.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

We claim:

1. An elevator system, comprising:

an elevator hoistway;

an elevator car moveable vertically within said hoistway;

a laser disposed on said elevator car, said laser providing a laser beam in at least one direction along said hoistway, said laser beam being scanned so as to proceed from being directed toward one side of the hoistway to being directed toward the other side of the hoistway, periodically;

one or more pairs of sensors, each pair having one sensor mounted on one side of said hoistway and the other sensor mounted on the other side of said hoistway;

and a signal processor responsive to said sensors, said signal processor measuring the time for said laser to scan from one sensor of a pair to another sensor of said pair and calculating, from that time, the vertical distance of said elevator car from said sensor pair, and thereby the position of said elevator car in said hoistway.

2. A system according to claim 1 wherein said signal processor calculates speed from successive values of vertical distance.

3. A system according to claim 1 wherein said signal processor calculates elevator acceleration from said values of vertical distance.

4. A system according to claim 1 comprising a plurality of pairs of sensors, each pair of sensors being vertically displaced in said hoistway from an adjacent pair of sensors.

5. A system according to claim 1 wherein said laser beam is directed in one direction only along said hoistway.

6. A system according to claim 1 wherein each of said sensors is individually connected to said signal processor, whereby to separately receive and identify signals unique to each sensor.

* * * * *